United States Patent [19]

Blower et al.

[11] Patent Number: 4,588,014

[45] Date of Patent: May 13, 1986

[54] FOUNDRY MOLDING APPARATUS AND METHOD

[75] Inventors: Warren A. Blower, Brecksville; Rudolf Hermes, Parma, both of Ohio

[73] Assignee: Osborn Manufacturing Corporation, Cleveland, Ohio

[21] Appl. No.: 401,114

[22] Filed: Jul. 23, 1982

[51] Int. Cl.[4] ..... B22C 9/00

[52] U.S. Cl. ..... 164/29; 164/159; 164/168; 164/323; 164/374; 164/375

[58] Field of Search ..... 164/29, 137, 159, 168, 164/224, 322, 323, 339, 374, 375

[56] References Cited

U.S. PATENT DOCUMENTS

| | | | |
|---|---|---|---|
| 2,850,775 | 9/1958 | Northington, Jr. et al. | 164/168 X |
| 3,123,871 | 3/1964 | Taccone | 164/168 |
| 4,261,413 | 4/1981 | Blower et al. | 164/159 |
| 4,438,801 | 3/1984 | Buhler | 164/29 X |

*Primary Examiner*—Nicholas P. Godici
*Assistant Examiner*—J. Reed Batten, Jr.
*Attorney, Agent, or Firm*—Renner, Otto, Boisselle & Lyon

[57] ABSTRACT

Foundry molding system, apparatus and methods are characterized by horizontally reciprocating flask shuttles located beneath and at entry and exit ends of a molding line conveyor which is operative to support horizontally aligned cope and drag flask sets for indexing along the conveyor in abutting relation through a plurality of stations for production of cope and drag molds in the cope and drag flasks, respectively. The entry and exit flash shuttles respectively operate positively to locate and transfer along the conveyor one flask of cope and drag flask sets out of and into alignment with a flask separate/set-on and flask take-off/close to permit set-on and take-off of the other flask at high production rates. The flask separate/set-on and flask take-off/close each includes cope and drag flask lift arms which are provided with respective opposed guides that cooperate with specially constructed cope and drag flasks precisely to locate the flasks in the lift arms during flask separate/set-on and take-off/close operations. The foundry molding system also is characterized by relatively short entry and exit mold transfer conveyors strategically interposed between entry and exit ends of the molding line conveyor and respective portions of a cooling conveyor, respectively.

53 Claims, 12 Drawing Figures

FOUNDRY MOLDING APPARATUS AND METHOD

This invention relates generally to a foundry molding system and more particularly to apparatus and methods having particular application therein and in a foundry molding system of the type disclosed in U.S. Pat. No. 4,261,413, issued Apr. 14, 1981.

BACKGROUND OF THE INVENTION

Present day automatic high production foundry installations utilize high pressure squeeze molding machines in a molding line to form cope and drag molds in respective flasks. The cope and drag molds are then cored, if necessary, and assembled to form complete foundry molds which are then placed on a pouring and cooling conveyor for casting. After the casting has cooled, the cope and drag flasks are punched out to remove the molding sand and casting therefrom, separated, and then recycled through the molding line.

In high production units for large size flasks, the molding lines may either be "in-line" or "cross-loop" systems. In a "cross-loop" system, the cope and drag molds are generally molded separately in parallel conveyor systems each crossing a loop of a pouring and cooling conveyor. In an "in-line" system, the molding line generally extends parallel to the pouring and cooling conveyor and the cope and drag flasks are conveyed through the molding line in alternating cope and drag flask sets. The molding machines are then next to each other on a single conveyor. Both "in-line" and "cross-loop" mold production units have been manufactured for many years by the Osborn Manufacturing Corporation of Cleveland, Ohio.

In conventional "in-line" molding systems, the flasks are driven through the molding line by a number of clutch and brake operated powered conveyor rolls which require relatively sophisticated and expensive controls so that each flask will be properly positioned for the variety of operations which must be performed thereon. Typically, the foundry mold with the cool casting therein is placed on the entrance of the molding line and after the casting and sand has been punched from the cope and drag flasks, such flasks are cleaned and separated. The cope and drag flasks are then driven into the cope and drag molding machines which conventionally include an elevating table which includes a pattern plate. The flasks are filled with sand and elevated against a squeeze board to form the pattern impression on the lower face of the mold thus formed in each flask. The flasks with the molds therein are then replaced on the molding line conveyor and moved therealong through a coring station and drag roll over station, the latter of which inverts the drag flask so that the pattern cavity in the drag mold face is facing upwardly. After coring and drag roll over, the cope and drag flasks with the molds therein are assembled with the cope mold on top and the drag mold on the bottom and then placed on the pouring and cooling conveyor.

For each of the above described operations, the cope and drag flasks must be relatively precisely centered and must be slightly spaced from each other to avoid interference. Accordingly, when a power driven conveyor is employed, the conveyor itself and particularly the controls for the drives can become inordinately expensive in addition to being a very high maintenance item.

It of course would be desirable if the sets of cope and drag flasks could be simply pushed through the molding line in abutting relationship; however, some means must be found to center and separate the flasks for each of the above noted operations. Moreover, when the flasks are again indexed by pushing, the slack or spacing between the flasks will be taken up, and like the last car on a railroad train, a flask may be subjected to a substantial jolt or bump when the slack is taken out of the line of flasks. This can cause damage or disintegration to a mold previously formed and can of course damage a flask. Accordingly, molding lines which employ abutting flasks pushed along an idler conveyor have numerous drawbacks which limit both productivity and reliability.

A foundry molding system overcoming many of the drawbacks associated with such molding lines is disclosed in the aforenoted U.S. Pat. No. 4,261,413. Such system has been successfully employed and provides desirable and advantageous results.

In particular, the foundry molding system disclosed in U.S. Pat. No. 4,261,413 includes a linear idler molding line conveyor adjacent a cooling conveyor. The molding line conveyor utilizes flanged idler rollers, such as those sold by the Osborn Manufacturing Corporation under the trademark LOAD RUNNER, which are journaled on stub shafts projecting inwardly from conveyor rails to support the cope and drag flasks on the flanged lower side edges thereof. Relatively short powered roller sections are provided at the entrance and exit ends of the idler roller section for flask disassembly and assembly in the set-off and closing operations described in such patent. As disclosed, a set-off removes the assembled cope and drag flasks from the cooling conveyor and forms them into horizontally abutting cope and drag flask sets on the molding line conveyor whereas a set-on at the other end of the molding line conveyor closes and sets the assembled cope and drag flasks with respective molds therein on the cooling conveyor.

Further in such system of U.S. Pat. No. 4,261,413, the cope and drag flask sets are controllably indexed along the molding line conveyor by indexing and control devices at opposite ends of the conveyor, each indexing step moving the flasks a distance slightly more than the horizontal length of a single set of cope and drag flasks. Positioned strategically along the molding line conveyor are opposed sets of power operated roller detents or locators which cooperate with horizontally spaced bars forming detent receptacles on each flask. Such locators separate and center the flasks for the various operations.

It further is noted that the set-off and set-on of such system each includes a vertically movable cope pick-up and a vertically movable drag pick-up which also is horizontally shiftable at right angles to the molding line conveyor and the adjacent cooling conveyor. The drag pick-up has pivoting lift arms adapted to engage and lift the top flange of the drag flask whereas the cope pick-up has L-shaped lift arms adapted to engage the top flange of the cope flask. During the closing operation, the cope flask is first moved into and picked up by the cope pick-up of the set-on, and then the short powered roller section associated with the set-on is operated to move the drag flask into the set-on. As the drag flask is then elevated by the drag pick-up, the drag mold therein is closed against the bottom of the cope mold in the cope flask and the thusly formed assembly is lifted off the cope pick-up arms a short distance and brought to bear against a stop to provide a controlled crush of the sand face between the cope and drag molds. Thereafter, the drag pick-up supporting the completed foundry mold is horizontally shifted above the cooling conveyor and lowered to place the mold onto the cooling conveyor. As the cope flask is coextensive with the cope pick-up arms during such horizontal shifting, the ends of the cope flask are recessed to clear the flange engaging portions of such arms.

SUMMARY OF THE INVENTION

The present invention is principally directed to improvements upon the foundry molding system described in U.S. Pat. No. 4,261,413 which, in particular, provide for positive locating and controlled transfer of flasks during separation and formation of vertically assembled cope and drag flasks into horizontally aligned cope and drag flask sets on a linear idler molding line conveyor and during take-off and closing of the flask sets with cope and drag molds therein to form vertically assembled cope and drag molds, i.e., completed foundry molds. In addition, the present invention reduces the number of locators needed along the molding line conveyor for separating and centering purposes. Overall, the present invention provides for increased productivity and reliability.

According to one aspect of the invention, short stroke, horizontally reciprocating flask shuttles at entry and exit ends of a molding line respectively operate positively to locate and transfer one flask of cope and drag flask sets out of and into alignment with a flask separate/set-on and flask take-off/close to permit set-on and take-off of the other flask. Such shuttles eliminate, for example, slipping and sliding of flasks previously encountered with powered roller conveyor sections whereby the set-on and take-off operations can be performed more quickly to obtain high mold production rates.

According to another asepct of the invention, cope and drag pick-ups of the flask separate/set-on and flask take-off/close are provided with opposed guides in respective lift arms thereof which cooperate with specially constructed flasks precisely to locate the flasks therein during set-on and closing operations. This ensures in-track set-on of the flasks on the molding line conveyor by the flask separate/set-on and proper closing of the flasks by the flask take-off/close. The specially constructed cope and drag flasks also permit lifting of vertically assembled cope and drag flasks above and clear of the cope pick-up arms for horizontal shifting of the assembled flasks relative to the cope pick-up arms and perpendicularly to the molding line.

According to still another aspect of the invention, relatively short entry and exit mold transfer conveyors are strategically interposed between entry and exit ends of a molding line conveyor and respective portions of a cooling conveyor, respectively, and each transfer conveyor is provided with a flask feeder or other means for moving flasks therealong for various operations. In particular, the entry mold transfer conveyor has an intermediate casting punch-out/brush-out station associated therewith whereas the exit mold transfer conveyor has an intermediate idle station.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWINGS

In the annexed drawings:

FIG. 5 is a fragmentary side elevation of the drag pick-up lift arm of FIG. 4 as seen from the line 5—5 thereof;

FIG. 6 is a fragmentary section taken substantially on the line 6—6 of FIG. 5;

FIG. 7 is an enlarged fragmentary side elevation of two of the cope pick-up lift arms employed in the take-off/close machine, such being shown with a cope flask supported thereon;

FIG. 8 is a fragmentary section taken substantially on the line 8—8 of FIG. 7;

FIG. 9 is an enlarged top plan view of the flask transfer located at the exit end of the molding line and seen at the right in FIG. 2B;

FIG. 10 is a vertical section taken substantially on the line 10—10 of FIG. 9; and FIG. 11 is another vertical section taken substantially on the line 11—11 of FIG. 10.

DETAILED DESCRIPTION

Figure 1:
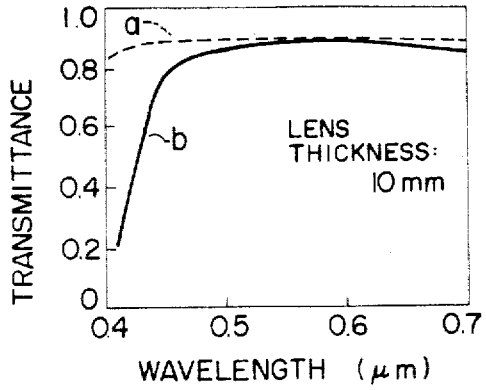
FIG. 1 is a partial schematic plan view of a foundry molding system according to the present invention.

Referring now in detail to the drawings and initially to FIG. 1, a foundry molding system can be seen to include a pouring and cooling line 20 and a mold transfer and assembly line 21 which has entry and exit ends extending generally parallel and adjacent to respective portions of the pouring and cooling line. The pouring and cooling line essentially consists of a bottom board or pallet conveyor 22 on which vertically assembled cope and drag molds are placed for casting. After the mold has traversed the length of the pallet conveyor and the casting has cooled, the molds are removed from the pallet conveyor and cycled through the mold transfer and assembly line 21.

GENERAL ARRANGEMENT OF THE MOLD TRANSFER AND ASSEMBLY LINE

As seen in FIG. 1, the mold transfer and assembly line 21 comprises for the most part a molding line conveyor 24 and relatively short entry and exit mold transfer conveyors 25 and 26. The entry mold transfer conveyor 25 extends adjacent and parallel to the molding line conveyor 24 at the entry end thereof seen at the left in FIG. 1 as well as to a portion of the pallet conveyor 22, the pallet conveyor being on one side of the entry mold transfer conveyor and the molding line conveyor on the other side. Similarly, the exit mold transfer conveyor 26 extends adjacent and parallel to the molding line conveyor but as its exit end seen at the right in FIG. 1. In addition, the exit mold transfer conveyor is adjacent and parallel to a respective portion of the pallet conveyor.

With additional reference to FIGS. 2A and 2B, the molding line conveyor 24 includes parallel side rails 28 and 29 which are supported above the floor 30 by legs 31 and the legs or vertical frame members of the hereinafter described molding line components associated with the molding line conveyor. The side rails of the conveyor 24 are horizontal and parallel and preferably are formed in segments which tie the various molding line components together within certain relatively close tolerances. Although not shown, flanged idler rollers are journaled on inwardly projecting stub shafts secured to each conveyor side rail 28, 29. Such flanged idler rollers may be of the type sold by the Osborn Manufacturing Corporation of Cleveland, Ohio under the trademark LOAD RUNNERS. The entry and exit mold transfer conveyors 25 and 26 may be similarly constructed and supported by legs and the legs or vertical frame members of hereinafter described components associated therewith.

Figure 2:
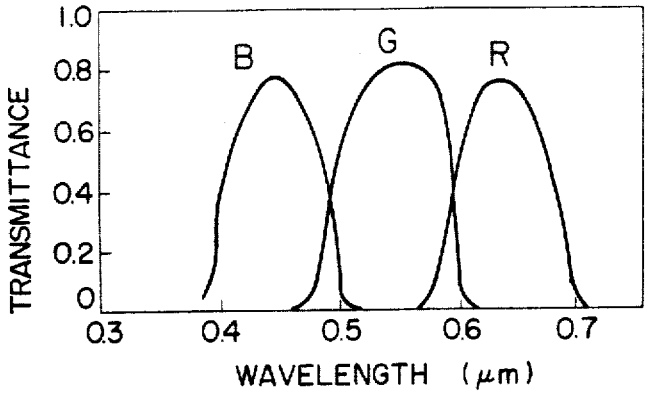
FIGS. 2A and 2B are broken continuations of each other illustrating the molding line of the system of FIG. 1 in side elevation as seen from the line 2A,B—2A,B of FIG. 1.

Generally going from left to right in FIG. 1 and FIGS. 2A and 2B, the components of the mold transfer and assembly line 21 sequentially are a mold set-off machine 34, a mold and flask feeder 35, a casting punch-out/brush-out machine 36, a flask separate/set-on machine 37, a molding line index mechanism 38, a drag molding machine 39, a cope molding machine 40, a cope sprue drill machine 41, a drag roll-over 42, a mold take-off/close machine 43, a molding line index control 44, and a mold set-on machine 45.

In general operation of the mold transfer and assembly line 21, a cope and drag mold having a cooled casting therein is removed from the pallet conveyor 22 and placed on the entry mold transfer conveyor 25 by the mold set-off machine 34. The mold and flask feeder 35 is then operated to push the mold into the casting punch-out/brush-out machine 36 which removes the sand and casting from the mold or more accurately the cope and drag flasks containing the mold. After the punch-out and brush-out operation has been completed, the feeder 35 is again operated to push the cleaned and still vertically assembled cope and drag flasks into alignment with the flask separate/set-on machine 37.

The flask separate/set-on machine 37 now picks up the assembled cope and drag flasks and positions the same above the molding line conveyor 24 for separation and sequential placement on the molding line conveyor at its entry end. The drag flask is first placed on the molding line conveyor and then the cope flask after the drag flask has been moved rearwardly by a flask transfer 50 to clear the way for the cope flask. In this manner, a drag and cope flask set is formed horizontally in line with previously formed drag and cope flask sets on the molding line conveyor, the drag flask and cope flask of each set being commonly designated by reference letters D and C, respectively.

After the drag and cope flask set is thus formed by the flask separate/set-on machine 37, the mold line index mechanism 38 pushes the drag and cope flask set to the right as seen in FIGS. 1 and 2A to clear the flask separate/set-on machine. When the index mechanism is retracted, a new set of drag and cope flasks may then be similarly positioned on the molding line conveyor 24, such drag and cope flasks having previously been removed from the pallet conveyor 22 and cleaned in the above indicated manner.

From the flask separate/set-on machine 37, the drag and cope flasks move into the positions seen at 54 and 55 wherein they are retained or held against movement by opposed pairs of locators commonly designated by reference numeral 56. The drag flask held in the position 54 will be clear of the flask separate/set-on machine 37 so that such machine can position the next set of flasks on the molding line conveyor 24. The cope flask in the position 55 is held clear of the drag molding machine 39.

After the next set of flasks has been formed on the conveyor 24 horizontally in line with the flasks in the positions 54 and 55, the index mechanism 38 is again operated whereupon the drag and cope flask will move from their positions seen at 54 and 55 into the drag and cope molding machines 39 and 40, respectively. In the drag and cope molding machines 39 and 40, the drag and cope flasks are positioned on pattern plates and filled with sand to form respective drag and cope molds. When filled with sand, the molds are subjected to squeeze and jolt operations which pack the sand in the flasks.

After the molds have been formed in the drag and cope flasks and after the flask separate/set-on machine 37 has formed another set of flasks at the entry end of the molding line conveyor 24, the locators 56 are retracted and the mold line index mechanism 38 again operated to move the flasks along the molding line conveyor in abutting fashion. When this is done, the drag and cope flasks with the molds therein will be pushed from the drag and cope molding machines to the locations seen at 58 and 59 wherein the flasks will again be engaged by other opposed sets of locators 56. The locators hold the drag flask with the mold therein in the location 58 clear of the cope molding machine 40 and the cope flask with the mold therein in the location 59 clear of the drag roll-over 42. The locators holding the cope flask in the position 59 also center such cope flask with the cope sprue drill machine 41 for a cope mold coring operation.

The next time the index mechanism 38 is operated, a drag flask will be positioned in the drag roll-over 42 and the cope flask will be positioned in the forwardly adjacent location 60 whereat another pair of opposed locators 56 will hold the cope flask clear of the roll-over. With the drag flask positioned and located in the roll-over 42, such flask is inverted to cause the pattern surface of the mold therein to face upwardly. When inversion is complete, the drag flask is released from the roll-over and the locators 56 are retracted for commencement of the next index stroke.

From the drag roll-over 42, the drag flask will then move upon indexing into a first coring area location seen at 64 whereas the cope flask will move into the location 65. During successive index strokes, the drag flask sequentially will move to the positions 66, 67 and 68, all such positions being in the coring area 69. Thus the drag flask will be in position in the coring area for three cycles of the molding line which is adequate time to place cores in the pattern cavity of the drag mold. At the same time, the cope flask sequentially will be moved to the positions 70, 71 and 72. In its final position, the cope flask will be held in the position 72 by another set of opposed locators 56.

Upon the next index stroke, the cope flask will be moved into a take-off location 74 in the take-off/close machine 43 whereas the drag flask will move to a forwardly adjacent position seen at 75. The take-off/close machine then will pick up the cope flask and hold the same in an elevated position above the molding line conveyor as the drag flask is moved into the take-off/close machine by a flask transfer 76. When thusly positioned at the location 74, the drag mold is then picked up by the take-off/close machine and sufficiently elevated to close the mold therein against the mold in the cope flask under controlled crush. After closing, the assembled drag and cope molds are horizontally shifted at right angles to the molding line conveyor 24 to a position above the exit mold transfer conveyor 26 for subsequent placement of the assembled drag and cope molds on such transfer conveyor.

After placement of the assembled cope and drag mold on the exit mold transfer conveyor 26, the mold assembly is transferred by suitable means to an idle station 78 where the mold assembly will remain until caused to be moved into the mold set-on machine 45. As the mold assembly is moved into the set-on machine, it will move over a drag mold strike-off mechanism 79. Upon completion of the strike-off operation, the mold set-on machine transfers the finished mold to the pallet conveyor 22 for pouring and cooling of a casting.

Reverting briefly to the take-off and closing operation, it will be appreciated that the locations 74 and 75 are empty upon completion of such operation. At this point, the molding line index control 44 is operated to engage the cope flask in the location 72 and move the same rearwardly to take up any slack in the line of flasks supported on the molding line conveyor 24. This is done before each time the flasks are indexed by the molding line index mechanism 38.

The molding line index control 44 further cooperates with the molding line index mechanism 38 to provide for controlled indexing of the flasks along the molding line conveyor 24. For a more detailed discussion of the indexing operation, reference may be had to U.S. Pat. No. 4,261,413, which is hereby incorporated herein by reference.

Reference also may be had to such U.S. Pat. No. 4,261,413 wherein components substantially like those identified above are shown and described in greater detail. In particular, the drag and cope molding machines 39 and 40, drag turn-over 42, molding line index mechanism 38 and molding line index control 44 may be constructed and operated in substantially the same manner as described in such patent. In addition, the flask separate/set-on machine 37 and mold take-off/close machine 43 are generally similar to the set-on machine and set-off machine described in such patent as will be further discussed hereinafter. As for the mold set-off machine 34, mold and flask feeder 35, casting punch-out/brush-out machine 36, cope sprue drill machine 41, and mold set-on machine 45, such may be of conventional construction suitable for carrying out the above indicated operations performed thereby.

FURTHER DESCRIPTION OF THE FLASK SEPARATE/SET-ON MACHINE AND THE MOLD TAKE-OFF/CLOSE MACHINE

The flask separate/set-on machine 37 and the mold take-off/close machine 43 are essentially identical in construction and accordingly only the mold take-off/close machine will be described in detail.

Figure 3:
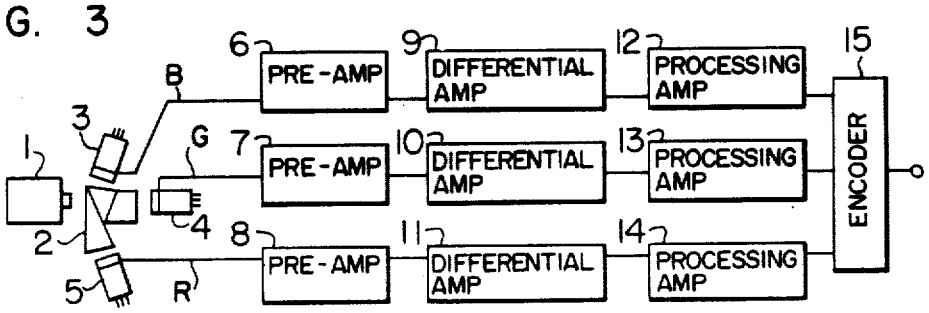
FIG. 3 is an enlarged side elevation of the take-off/close machine at the exit end of the molding line of FIG. 2B as seen from the line 3—3 of FIG. 1.

Referring now to FIG. 3, the mold take-off/close machine 43 includes a fabricated frame 81 having three laterally arranged pairs of legs 82. Only the pair closest the viewer in FIG. 3 can be seen, it being understood that the other two pairs are aligned therebehind. It also should be understood that the illustrated pair and next adjacent pair straddle and support the molding line conveyor 24 whereas such next adjacent and the furthest pair straddle and support the exit mold transfer conveyor 26. The top of respective legs 82 of the pairs are interconnected by laterally extending parallel frame members 83 and the legs of each outermost pair are interconnected by respective cross frame members 84. The parallel frame members 83 support inwardly disposed parallel rails (not shown) on which a carriage 85 is mounted for movement therealong. The carriage 85 is powered for horizontal reciprocating movement by relatively long stroke piston-cylinder assembly seen generally at 86 in FIG. 1 between respective positions above the molding line conveyor 24 and exit mold transfer conveyor 26. Respective pairs of shock absorbers 87 may be mounted on the cross frame members 84 at each end of the travel of the carriage 85.

The carriage 85 supports a drag pick-up seen generally at 90. The drag pick-up 90 includes an elevator frame 91 which is connected to the piston rod of piston-cylinder assembly 92 which in turn is connected at its cylinder to the piston rod 93 of a piston-cylinder assembly 94 mounted on the carriage 85. Accordingly, extension of one or both of the piston-cylinder assemblies 92, 94 lowers the elevator frame 91 whereas retraction of same raises the elevator frame.

The elevator frame 91 has journaled to the underside thereof parallel shafts 98 to which are secured drag lift arms 99. Only the shaft and lift arm closest the viewer can be seen in FIG. 3, it being understood that the other shaft and pick-up arm are aligned therebehind, respectively. It also should be understood that the lift arms are arranged to engage opposite sides of a drag flask D when pivoted toward each other, such pivoting being effected by suitable means such as a piston-cylinder assembly commonly connected to the shafts 98 by a linkage and crank assembly. The arms may also be swung away from each other to a retracted position clearing the drag flask.

Figure 4:
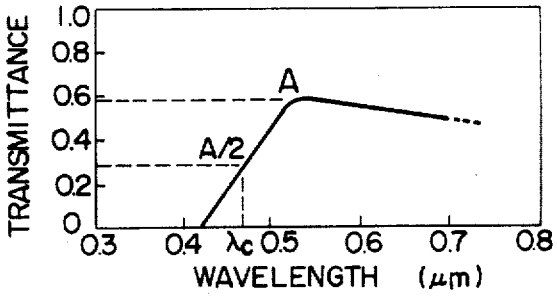
FIG. 4 is an enlarged fragmentary end elevation of one of the drag pick-up lift arms employed in the take-off/close machine as seen from the line 4—4 of FIG. 3, such being shown just after depositing a vertically assembled cope and drag flask combination onto a conveyor.

As seen in FIGS. 4–6, each lift arm 99 includes two spaced sets of parallel, elongated plates 102. When the lift arm is in its engaged position, the elongated plates 102 extend vertically in a plane clearing the adjacent side flanges of the drag flask D which is described below in greater detail. Each lift arm also includes at its lower end a foot assembly 103 which extends between and is secured beneath the plates 102 and is generally L-shape when viewed endwise as in FIG. 4.

The upper leg of the foot assembly 103 is formed by spaced vertical blocks 107 secured by horizontal plates 108 beneath the plates 102 whereas the lower leg of the foot assembly extends inwardly and perpendicularly with respect to the vertical blocks 107. The lower leg of the foot assembly for the most part is formed by an elongated plate 110 having inwardly extending end portions 111 designed to fit beneath the adjacent top side flange of the drag flask at opposite ends thereof when the lift arms 99 are swung into their engaged position and elevated. The lower leg also includes a pair of horizontally spaced guide rollers 112. The guide rollers 112 are journaled on vertical shafts 113 between vertically spaced, horizontal roller mounting plates 114 and 115 which are secured beneath the flange support plate 110 and vertically spaced by spacer plates 116. As seen in FIGS. 4 and 6, the rollers 112 project inwardly beyond the support plate 110 and together form a guide pocket 117 which cooperates with locating elements on the adjacent side of the drag flask.

In order to fully appreciate the manner in which the lift arms 99 engage the drag flask D, the construction of the drag flask will now be described. With reference to FIGS. 4–6, the drag flask includes side walls 121 interconnected by front and back end walls 122 and 123 to form a rectangular box. The side walls are not as high as the front and back walls and are each provided with laterally projecting top and bottom side flanges 124 and 125, the top and bottom surfaces respectively being flush with the top and bottom surfaces of the front and back end walls. The outer edges interiorly of the flanges 124 and 125 are recessed at 126 and 127, respectively, for reasons associated with the drag roll-over 42.

Each side wall 121 projects beyond the front and back end walls 122 and 123 in a truncated triangular shape, the corners of the truncation being rounded to form fore and aft laterally spaced bumpers 130 and 131 by which the drag flask D is indexed or pushed along by an adjacent flask or the index mechanism in the manner more fully described in U.S. Pat. No. 4,261,413.

Each flange 124, 125 is provided with a centrally located guide bushing 133 to receive guide pins projecting from the cope flask when the flasks are closed. Such guide bushings also may be employed with guide pins for alignment purposes during the molding operation. It is noted that the bushings 133 are spaced inwardly of the shoulder of the recesses 126 and 127 and are centrally located between two vertically extending rods 135 which form a detent receptacle 137 therebetween for cooperation with the aforementioned locators 56. For a more detailed description of the locators 56 and their cooperation with the detent receptacle 137, reference may be had to U.S. Pat. No. 4,261,413.

Again with reference to the drag pick-up 90, the vertically extending rods 135 on opposite sides of the drag flask D also serve as opposed catches which are respectively receivable in the opposed guide pockets 117 formed by the guide rollers 112 of the drag lift arms 99. As the lift arms are swung to their lowered or engaged position seen in FIGS. 4–6, the vertical rods 135 will be forced by the guide rollers 112 to a centered position therebetween. To this end, the rods 135, for example, may be approximately 1⅜" in diameter and on 4" centers whereas the guide rollers 112 may be approximately 3" in diameter and on 6½" centers. Accordingly, the guide rollers provide a pocket having a minimum width of about 3½" compared to the overall catch width of about 5⅜". The guide rollers thus act as moving guide surfaces which cooperate with the catch or more accurately the vertical rods properly to position the drag flask in the drag pick-up. More particularly, the cooperation between the guide rollers and vertical rods will center the guide bushings 133 of the drag flask in the drag pick-up for alignment thereby with guide pins projecting from the cope flask, which pins are correspondingly centered in the below discussed manner.

Reverting now briefly to FIG. 3, the take-off/close machine 43 further includes a cope pick-up shown generally at 140 which simply moves vertically above the molding line conveyor 24. The cope pick-up includes a pair of laterally extending, parallel frame members 141 which are mounted for vertically guided movement on the fabricated frame 81. Vertical movement of the parallel frame members 141 may be effected by a piston-cylinder assembly 142 in a manner similar to that described in U.S. Pat. No. 4,261,413.

Projecting inwardly and downwardly from each end of the parallel frame members 141 are cope lift arms 145 which can be seen in FIG. 3 to be generally L-shaped. Each cope lift arm includes a long leg 146 which extends vertically and clears the cope and drag flasks C and D whether moved longitudinally or laterally with respect to the cope pick-up, i.e., whether the flasks are moved in a direction parallel to the molding line conveyor 24 or in a direction normal to such conveyor.

As best seen in FIGS. 7 and 8, the short leg of each cope lift arm 145 is formed by an inwardly projecting shoe in the form of a horizontal plate 150 secured beneath the long leg 146. The plate 150 projects longitudinally and laterally inwardly with respect to the adjacent top flange 151 of the cope flask C which is generally similar in construction to the drag flask D, and has mounted thereon a rest button 152 designed to engage the underside of the cope flask top flange.

The horizontal plate 150 also has mounted thereon a flange end guide or locating roller 154 which is journaled on a stub shaft 155 projecting laterally inwardly from a longitudinally aligned, vertical bracket 156 secured on top of the plate 150. Also provided is a flange side guide or locating roller 157 which is journaled on a stub shaft projecting longitudinally inwardly from a laterally aligned, vertical bracket 159 secured on top of the plate 150. Accordingly, the respective axes of the locating rollers 154 and 157 extend horizontally and at right angles to each other for respective engagement with the end and side of the cope flask top flange 151 at the adjacent corner thereof.

It thus should be apparent that as the plates 150 of the cope lift arms 145 are elevated from a position beneath adjacent corners of the cope flask top flanges 151, the locating rollers 154 and 157 will engage the ends and sides of the top flanges 151 and guide cope flask to a centered position in the cope pick-up 140 as the top flanges come to rest on the rest buttons 152. Accordingly, the locating rollers at the four corners of the cope pick-up act as opposed moving guide surfaces which cooperate with the cope flask, or more particularly the top flanges thereof, properly to center the cope flask in the cope pick-up.

Referring now more particularly to the construction of the cope flask C, such construction as previously indicated is generally similar to that of the drag flask D and includes side walls 161 and front and back walls 162 and 163. The side walls 161 are each provided with the aforementioned laterally projecting top flange 151 and a bottom flange 164 between which are secured vertical rods 165 forming a central receptacle 166 for the locators 56. A guide pin 167 also is centrally secured to and projects downwardly from each bottom flange 164 midway between the vertical rods 165. The guide pin is of course designed to fit into a corresponding guide bushing 133 of the drag flask D.

The flanges 151 and 164 of the cope flask C project laterally to the same extent and in the same manner as the flanges 124 and 125 of the drag flask D as best seen in FIG. 4. The bottom flanges 164 of the cope flask also project longitudinally to the same extent as the flanges 124 and 125 of the drag flask whereas the top flanges 151 project both fore and aft of the bottom flanges 164, as best seen in FIG. 7, to create front and back overhangs 170 and 171. During elevation and lowering of the cope flask, it is the overhangs 170 and 171 which are engaged by the cope lift arms 145 which otherwise laterally and longitudinally clear the bodies of the cope and drag flasks.

In operation of the take-off/close machine 43, the cope pick-up 140 will be in its down or lowered position as a cope flask C is indexed to the location 74. As the cope flask is thusly indexed, the top flanges 151 thereof will move over the cope engaging shoes 150 of the cope pick-up whereupon the cope pick-up is elevated to lift the cope flask at the overhands 170 and 171 from and clear of the molding line conveyor 24. During initial elevation of the cope pick-up, the locating rollers 154 and 157 will engage opposite ends and sides of the top flanges and guide the cope flask to a centered position as the top flanges come to rest on the rest buttons 152. Accordingly, the guide pins 167 of the cope flask will be precisely centered.

With the cope flask C held in an elevated position, the drag flask D is moved from the position 75 to the position 74 beneath the cope flask C by the flask transfer 76. The drag pick-up 90 may then be lowered and the lift arms 99 thereof swung to their lowered or engaged positions. As the lift arms are thusly swung into position, the catches formed by the rods 135 on opposite sides of the drag flask will be respectively received in the opposed guide pockets 117 formed by the guide rollers 112 of the lift arms 99. Accordingly, the drag flask will be precisely centered and, more particularly, the guide bushings 133 therein will be precisely vertically aligned with the correspondingly centered guide pins 167 projecting from the cope flask.

The elevator frame 91 may now be elevated to pick up the drag flask D and close the drag mold therein against the bottom of the cope mold in the cope flask C to form a cope and drag mold assembly. After closing, continued elevation of the elevator frame 91 lifts the cope flask off the cope engaging shoes 150 and brings it to bear against a suitable stop to provide a controlled crush of the sand face between the cope and drag molds. After crush, the cope and drag assembly is disengaged from the stop and held by the drag pick-up 90 vertically above and clear of cope engaging shoes 150 as the carriage 85 is moved laterally to position the cope and drag assembly above the exit mold transfer conveyor 26. The elevator frame 91 may then be lowered to place the cope and drag mold assembly on the exit mold transfer conveyor 26 whereupon the assembly is transferred to the idle station 78. When the cope and drag assembly clears the drag pick-up 90, the machine may then recycle to take off and assemble another cope and drag flask/mold set in the same manner.

The separate/set-on machine 37 operates in a similar but reverse manner to the take-off/close machine 43. Although such reverse operation should be readily apparent, briefly it is noted with reference to FIGS. 1 and 2A that an assembled cope and drag flask combination will be picked up from the entry mold transfer conveyor 25 by the drag pick-up 180 of the machine 37. The combination is then laterally moved to a position above the molding line conveyor 24. As the combination moves into such position, the top flange of the cope flask will move above the elevated cope engaging shoes 181 of the cope pick-up 182. At this point, the drag pick-up is lowered to place the drag flask onto the molding line conveyor, it being appreciated that the cope engaging shoes 181 will catch the cope flask and separate it from the drag flask. With the cope flask held by the cope pick-up clear of the molding line conveyor, the drag flask may then be moved out of alignment with the set-on/separate machine by the flask transfer 50. When the drag flask is clear of the machine 37, the cope pick-up may then be lowered to set the cope flask on the molding line conveyor 24 horizontally in line with the drag flask and previously formed drag and cope flasks sets already formed and indexed forwardly along the conveyor.

THE FLASK TRANSFERS

The flask transfers 50 and 76 respectively associated with the flask separate/set-on machine 37 and the mold take-off/close machine 43 are substantially identical and accordingly only the flask transfer 76 will be described in detail.

Referring now to FIGS. 9–11, the flask transfer 76 includes a rectangular horizontal base frame 160 which is supported beneath the molding line conveyor 24 on the floor by feet 161'. The base frame 160 includes parallel frame members 162' which extend longitudinally with respect to the molding line conveyor and parallel front and rear cross frame members 163' and 164' at opposite ends of the frame members 162'. Mounted fore and aft on the frame members 162' are brackets 165' which support longitudinally extending, parallel roller bars 166'. Projecting inwardly from each roller bar are two horizontal rows 167' and 168' of flanged rollers which are vertically spaced to accommodate therebetween parallel rails **169*a* on opposite sides of a horizontally shiftable shuttle 169**.

As seen in FIGS. 10 and 11, the shuttle 169 includes a carriage 171' in the form of a rectangular frame consisting of longitudinally extending parallel frame elements 172 and laterally extending front and rear cross frame elements 173 and 174. The aforementioned parallel rails **169*a* are secured to and project outwardly from the longitudinal frame elements 172**.

The carriage 171' is powered for horizontal reciprocating movement in line with the molding line conveyor 24 by a piston-cylinder assembly seen at 175. The cylinder 176 of such assembly is pivotally mounted in a trunnion 177 depending from the rear cross frame member 164' of the base frame 160. The rod 178 of such assembly is pivotally connected to the carriage by a rod eye assembly 179 and clevis 180' respectively secured to the rod and front cross frame element 173 of the carriage 171'. Also provided is a shock absorber 181' which is centrally mounted on the front cross frame member 163' of the base frame. The shock absorber engages a stop block 182' centrally mounted on the front cross frame element 173 of the carriage at the end of travel of the carriage. A stop block 183 may also be provided at the rear cross frame element 174 for engaging a corresponding stop block 184 on the rear cross frame member 164' of the base frame at the end of travel of the carriage in the opposite direction. It should be appreciated that the shock absorber 181' prevents sudden stopping or jolting of the carriage which might cause damage to a drag mold as it is transferred into the position 74.

The shuttle 169 further includes front and rear bearing blocks 187 and 188 mounted in pairs on top of the carriage 171'. Journaled between each pair of bearing blocks are parallel shafts 189 and 190 to which are secured locating arms 191 and 192, each arm being secured centrally on each shaft. Each arm 191, 192 is provided at its upper end with a pad 193, 194 designed to engage the front and rear of a drag flask D positioned thereabove on the molding line conveyor 24, respectively.

The shafts 189 and 190 respectively have secured thereto downwardly projecting arms 195 and 196 which are laterally offset from the arms 191 and 192 and pivotally connected to connecting rods 197 and 198, respectively. The connecting rods 197 and 198 in turn are pivotally connected to opposite arms 199 and 200 of a crank 201 which is secured to a crankshaft 202 journaled between bearing blocks 203 mounted on top of the carriage 171' centrally between the shafts 189 and 190. The crankshaft 202 also has secured thereto a downwardly projecting crank arm 204 which is pivotally connected to the rod 205 of a piston-cylinder assembly 206. The cylinder 207 of such assembly is pivotally mounted in a trunnion 208 secured on top of the front cross frame element 173 of the carriage. Accordingly, when the piston cylinder assembly is retracted as seen in FIG. 10, the locating arms 191 and 192 will pivot upwardly and towards each other into engagement with the front and back of the drag flask. When the piston-cylinder assembly is extended, the arms 191 and 192 will swing downardly to their retracted or ambush position to clear the drag flask. The retracted position of the arm 191 is shown in phantom lines at 209 in FIG. 10. It also should be appreciated that the connecting rods 197 and 198 are adjustable in length to adjust the location of the drag flask relative to the carriage when such flask is engaged by the arms.

In operation, the shuttle 169 will be positioned beneath a drag flask D located at the position 75 in FIG. 2B. When thusly positioned, the piston-cylinder assembly 206 is retracted to swing the locating arms 191 and 192 into engagement with the drag flask thereby to precisely locate the drag flask in relation to the carriage 171'. At the same time, the drag flask will be shifted slightly to the left as seen in FIG. 2B to separate the drag flask from the cope flask C in the position 74 for take off of the latter by the take-off/close machine 43.

After the cope flask C at the position 74 has been lifted off the molding line conveyor 24 by the take-off/separate machine 43, the piston-cylinder assembly 175 is extended to move the shuttle 169 beneath the machine 43. At the same time, the shuttle will positively move the drag flask along the conveyor into the position 74 in alignment with the machine. As the drag flask previously had been shifted slightly to the left as seen in FIG. 2B, the stroke or travel of the shuttle will be slightly greater than the length of the flask so as to position properly the flask in the machine.

At this point, the piston-cylinder assembly 206 is extended to retract the locating arms 191 and 192 whereupon the drag flask D is now ready to be picked up by the drag pick-up 90 of the machine 43. When the locating arms are clear of the drag flask, the shuttle 169 may then be returned to its original position for similar locating and transfer of the next indexed drag flask.

The operation of the transfer 50 associated with the flask separate/set-on machine 37 is essentially the same. However, the transfer 50 will operate in reverse manner to move a drag flask D set on the molding line conveyor 24 by the machine 37 rearwardly to a position clear of the machine for permitting set-on of a cope flask C thereby to form a cope and drag flask set horizontally in line with previously formed sets on the molding line conveyor. Again, the stroke of the shuttle will be slightly greater than the length of a flask to provide desired clearance with the cope flask being set on the molding line conveyor.

It can now be seen that there is provided foundry molding apparatus and methods which provide for positive locating and controlled transfer of flasks during separation and formation of vertically assembled cope and drag flasks into horizontally aligned cope and drag flask sets on a linear idler molding line conveyor and during take-off and closing of the flask sets with cope and drag molds therein to form vertically assembled cope and drag molds, i.e., completed foundry molds. Also provided is a novel arrangement for effecting transfer of molds between a cooling line conveyor and molding line conveyor.

Although the invention has been shown and described with respect to a preferred embodiment, it is obvious that equivalent alterations and modifications will occur to others skilled in the art upon the reading and understanding of the specification. The present invention includes all such equivalent alterations and modifications, and is limited only by the scope of the following claims.

The embodiments of the invention in which an exclusive property or privilege is claimed are defined as follows:

1. A foundry molding apparatus comprising a conveyor, a cope and drag flask separate/set-on at the entry end of said conveyor operative to separate a vertically assembled cope and drag flask combination and sequentially to place one flask of such combination on said conveyor at an entry position thereof and then the other flask, a flask transfer operative positively to move and locate such one flask clear of such entry position to permit placement of such other flask on said conveyor to form a cope and drag flask set horizontally in line with previously formed cope and drag flask sets, and an index mechanism operative to index such sets and previously formed sets in abutting relationship along said conveyor through a plurality of stations for production of cope and drag molds.

2. An apparatus as set forth in claim 1, wherein said flask transfer includes a horizontally shiftable flask shuttle positioned beneath said conveyor.

3. An apparatus as set forth in claim 2, wherein said flask shuttle includes a horizontally reciprocating carriage, flask locating means on said carriage operative to engage and hold such one flask at a given location relative to said carriage, and means for moving said carriage parallel to said conveyor.

4. An apparatus as set forth in claim 3, wherein said locating means includes a pair of arms spaced longitudinally with respect to said conveyor operative respectively to engage front and rear ends of such one flask so as to hold such one flask therebetween.

5. An apparatus as set forth in claim 4, wherein said arms are retractable to a position clearing such one flask to permit indexing of such one flask along said conveyor.

6. An apparatus as set forth in claim 5, wherein said arms are pivoted on said carriage and means are provided to swing said arms between engaged and retracted positions thereof.

7. An apparatus as set forth in claim 6, wherein said means to swing includes a piston-cylinder assembly common to said arms, and means drivingly connecting said piston-cylinder assembly to said arms.

8. An apparatus as set forth in claim 7, wherein said means drivingly connecting includes a crank pivotally mounted on said carriage and respective connecting rods connecting said arms to opposed arms of said crank.

9. An apparatus as set forth in claim 8, wherein said connecting rods are adjustable in length to adjust the location of such one flask relative to said carriage when such one flask is engaged by said arms.

10. An apparatus as set forth in claim 3, wherein the stroke of said carriage is slightly greater than the length of such one flask.

11. An apparatus as set forth in claim 10, wherein said shuttle further includes shock absorber means engageable with said carriage at the end of the stroke thereof.

12. An apparatus as set forth in claim 2, wherein said shuttle moves such one flask rearwardly a distance slightly greater than the length of such one flask.

13. A foundry molding apparatus comprising a conveyor operative to support horizontally aligned cope and drag flask sets, and index mechanism operative to index such sets along said conveyor in abutting relation through a plurality of stations for production of cope and drag molds in the cope and drag flasks, respectively, a cope and drag mold take-off at the exit end of said conveyor operative sequentially to remove one mold containing flask of a horizontally aligned cope and drag mold set from said conveyor at an exit position thereon and then the other mold containing flask of such mold set, and transfer means operative to locate such other mold containing flask at an adjacent position clear of such exit position before removal of such one mold containing flask and then positively to move such other mold containing flask to such exit position after removal of such one mold containing flask thereby to permit removal of such other mold containing flask by said take-off.

14. An apparatus as set forth in claim 13, wherein said take-off includes means to close such one and other mold containing flasks to form an assembled cope and drag mold.

15. An apparatus as set forth in claim 13, wherein said flask transfer includes a horizontally shiftable flask shuttle positioned beneath said conveyor.

16. An apparatus as set forth in claim 15, wherein said flask shuttle includes a horizontally reciprocating carriage, flask locating means on said carriage operative to engage and hold such other mold containing flask at a given location relative to said carriage, and means for moving said carriage parallel to said conveyor.

17. An apparatus as set forth in claim 16, wherein said locating means includes a pair of arms spaced longitudinally with respect to said conveyor operative respectively to engage front and rear ends of such other mold containing flask so as to hold such other mold containing flask therebetween.

18. An apparatus as set forth in claim 17, wherein said arms are retractable to a position clearing the next mold set to permit indexing of the same along said conveyor.

19. An apparatus as set forth in claim 18, wherein said arms are pivoted on said carriage and means are provided to swing said arms between engaged and retracted positions thereof.

20. An apparatus as set forth in claim 19, wherein said means to swing includes a piston-cylinder assembly common to said arms, and means drivingly connecting said assembly to said arms.

21. An apparatus as set forth in claim 20, wherein said means drivingly connecting includes a crank pivotally mounted on said carriage and respective connecting rods connecting said arms to opposed arms of said crank.

22. An apparatus as set forth in claim 21, wherein said connecting rods are adjustable in length to adjust the location of such other mold containing flask relative to said carriage when such flask is engaged by said arms.

23. An apparatus set forth in claim 16, wherein the stroke of said carriage is slightly greater than the length of such other mold containing flask.

24. An apparatus as set forth in claim 23, wherein said shuttle further includes shock absorber means engageable with said carriage at the end of the stroke thereof.

25. An apparatus as set forth in claim 15, wherein said shuttle moves such other mold containing flask rearwardly a distance slightly greater than the length of such other mold containing flask.

26. An apparatus as set forth in claim 14, wherein said take-off includes a vertically movable cope pick-up for such one mold containing flask and a vertically movable drag pick-up for such other mold containing flask, and said cope and drag pick-ups include respective means for centering and holding centered the mold containing flasks therein.

27. An apparatus as set forth in claim 26, wherein said drag pick-up includes opposed locating pockets operative to engage respective centering catches on opposite sides of such other mold containing flask.

28. An apparatus as set forth in claim 27, wherein each locating pocket is formed by horizontally spaced rollers journaled for rotation on parallel axes.

29. An apparatus as set forth in claim 28, wherein each centering catch is formed by vertical rods horizontally spaced a distance less than the horizontal spacing of said rollers.

30. An apparatus as set forth in claim 27, wherein such other mold containing flask includes top and bottom flanges at the sides thereof, and each centering catch is formed by spaced rods extending between said flanges.

31. An apparatus as set forth in claim 30, wherein said drag pick-up includes opposed L-shape arms pivotable from a retracted position to a position engageable with such other mold containing flask, said arms when engaged having short legs projecting horizontally beneath the adjacent top flange of such other mold containing flask.

32. An apparatus as set forth in claim 31, wherein said locating pockets are formed by horizontally spaced rollers secured beneath said short legs, said rollers being journaled for rotation on parallel axes and spaced horizontally apart a distance greater than said spaced rods.

33. An apparatus as set forth in claim 26, wherein said cope pick-up includes an L-shape arm at each corner of such one mold containing flask supported thereby, said arm including at its lower end a short shoe projecting horizontally beneath an adjacent top flange of such one mold containing flask.

34. An apparatus as set forth in claim 33, wherein each shoe is provided with a pair of rollers having horizontal axes disposed at right angles to each other and arranged respectively to engage the end and side of an adjacent top flange of such one mold containing flask horizontally to center such one mold containing flask on said shoes.

35. An apparatus for producing foundry molds including a linear conveyor operative to support cope and drag flask sets for horizontal movement therealong, a frame straddling said conveyor, a reciprocating carriage mounted on said frame for movement to and from a position over said conveyor, an elevator mounted on said carriage, a drag pick-up mounted on said elevator, a cope pick-up mounted on said frame and vertically aligned with said drag pick-up in a position of said carriage over said conveyor, and means to move said cope pick-up vertically independently of said elevator, characterized by said cope pick-up including cope flask centering means for centering and holding centered a cope flask during pick-up thereof and said drag pick-up including drag flask centering means for centering and holding centered a drag flask during pick-up thereof.

36. An apparatus as set forth in claim 35, wherein said drag pick-up includes opposed locating pockets operative to engage respective centering catches on opposite sides of the drag flask.

37. An apparatus as set forth in claim 36, wherein each locating pocket is formed by horizontally spaced rollers journaled for rotation on parallel axes.

38. An apparatus as set forth in claim 37, wherein each centering catch is formed by vertical rods horizontally spaced a distance less than the horizontal spacing of said rollers.

39. An apparatus as set forth in claim 36, wherein such drag flask includes top and bottom flanges at the sides thereof, and each centering catch is formed by spaced rods extending between said flanges.

40. An apparatus as set forth in claim 39, wherein said drag pick-up includes opposed L-shape arms pivotable from a retracted position to a position engageable with the drag flask, said arms when engaged having short legs projecting horizontally beneath the top flange of the drag flask.

41. An apparatus as set forth in claim 40, wherein said locating pockets are formed by horizontally spaced rollers secured beneath said short legs, said rollers being journaled for rotation on parallel axes and horizontally spaced apart a distance greater than said spaced rods.

42. An apparatus as set forth in claim 35, wherein said cope pick-up includes an L-shape arm at each corner of the cope flask supported thereby, said arm including at its lower end a short shoe projecting horizontally beneath the top flange of the cope flask.

43. An apparatus as set forth in claim 42, wherein each shoe is provided with a pair of rollers having horizontal axes disposed at right angles to each other and arranged respectively to engage the end and side of an adjacent top flange of the cope flask horizontally to center the cope flask on said shoes.

44. A method of forming foundry molds comprising the steps of:

(a) separating a vertically assembled cope and drag flask combination;

(b) placing one flask of such combination on an idler conveyor at an entry position thereof;

(c) positively moving and locating such one flask along the conveyor clear of such entry position;

(d) placing the other flask of such combination on said conveyor at such entry position to form a cope and drag flask set horizontally in line with cope and drag flask sets previously formed on the conveyor; and then (e) indexing such set and previously formed sets in abutting relation along a conveyor through a plurality of stations for production of cope and drag molds therein.

45. A method as set forth in claim 44, wherein the step of positively moving and locating includes engaging and holding such one flask at a given location relative to a reciprocating carriage and moving the carriage parallel to the conveyor so as to move and locate such one flask at an adjacent position clear of such entry position.

46. A method as set forth in claim 45, wherein the step of engaging and holding includes engaging front and rear ends of such one flask with locating arms on the carriage.

47. A method as set forth in claim 46, further including the step of retracting the locating arms to clear such one flask so as to permit indexing of such one flask along the conveyor.

48. A method as set forth in claim 45, wherein such one flask is moved rearwardly to clear such entry position a distance slightly greater than the length of such one flask.

49. A method as set forth in claim 44, wherein said step of indexing includes indexing a horizontally aligned cope and drag mold set along the conveyor so as to locate one mold containing flask of such set at an exit position on said conveyor, positively locating the other mold containing flask of such set at an adjacent position clear of such exit position, removing such one mold containing flask at such exit position from the conveyor, positively moving the other mold containing flask from such adjacent position to such exit position, removing such other mold containing flask at such exit position from the conveyor, and closing such one and other mold containing flasks to form a vertically assembled cope and drag mold.

50. A method as set forth in claim 49, wherein said step of positively locating includes engaging and holding such other mold containing flask at a given location relative to a reciprocating carriage and such step of positively moving includes moving the carriage parallel to the conveyor so as to move and locate such other mold containing flask at an adjacent position clear of such entry position.

51. A method as set forth in claim 50, wherein the step of engaging and holding includes engaging front and rear ends of such other mold containing flask with locating arms on the carriage.

52. A method as set forth in claim 51, further including the step of retracting the locating arms to clear the next mold set to permit indexing of the same along the conveyor.

53. A method as set forth in claim 52, wherein such other mold containing flask is moved forwardly a distance slightly greater than the length of such other mold containing flask.

* * * * *